US010366679B1

(12) United States Patent
Chen

(10) Patent No.: US 10,366,679 B1
(45) Date of Patent: Jul. 30, 2019

(54) DRUM PEDAL

(71) Applicant: JAW CORPORATION, Taichung (TW)

(72) Inventor: Chang-Hui Chen, Taichung (TW)

(73) Assignee: JAW CORPORATION, Taichung (TW)

( * ) Notice: Subject to any disclaimer, the term of this patent is extended or adjusted under 35 U.S.C. 154(b) by 0 days.

(21) Appl. No.: 16/150,275

(22) Filed: Oct. 3, 2018

(51) Int. Cl.
*G10D 13/02* (2006.01)
*G10D 13/00* (2006.01)

(52) U.S. Cl.
CPC ..... *G10D 13/006* (2013.01)

(58) Field of Classification Search
CPC ..... G10D 13/006
See application file for complete search history.

(56) References Cited

U.S. PATENT DOCUMENTS 1,277,123 A * 8/1918 Riches ..... G10D 13/006 84/422.2
1,445,639 A * 2/1923 Mueller ..... G10D 13/006 84/422.2
1,479,376 A * 1/1924 Danly ..... G10D 13/006 84/422.2
1,501,278 A * 7/1924 Danly ..... G10D 13/006 84/422.2
1,564,839 A * 12/1925 Evans ..... G10D 13/006 84/422.1
3,030,847 A * 4/1962 Thompson ..... G10D 13/006 84/422.1
3,426,640 A * 2/1969 Slingerland, Jr. .... G10D 13/006 84/422.1
3,797,356 A * 3/1974 Duffy ..... G10D 13/006 74/512
4,567,808 A * 2/1986 Smith ..... G10D 13/006 84/422.1
5,388,494 A * 2/1995 Hoshino ..... G10D 13/006 84/422.1
5,431,081 A * 7/1995 Lombardi ..... G05G 1/30 84/422.1
5,578,777 A * 11/1996 Lombardi ..... G05G 1/30 84/422.1
5,610,351 A * 3/1997 Yanagisawa ..... G10D 13/006 84/422.1
5,646,360 A * 7/1997 Liao ..... G10D 13/006 84/422.1
5,659,144 A * 8/1997 Shigenaga ..... G10D 13/006 84/422.1
5,798,472 A * 8/1998 Shigenaga ..... G10D 13/006 84/413
6,172,291 B1 * 1/2001 Takegawa ..... G10D 13/006 84/422.1

(Continued)

*Primary Examiner* — Robert W Horn
(74) *Attorney, Agent, or Firm* — Leong C. Lei

(57) ABSTRACT

The present invention provides a sleeve mounted to an end or both ends of a shaft of the drum pedal. A T shaped screw cap runs through the sleeve and joins to a threaded rod, which in turn is connected to an end of an elastic element. The other end of the elastic element is hooked to the lower end of a column. The screw cap allows convenient and easy adjustment to the length of the elastic element and, therefore, the force of exertion when pressing down the pedal board. The drummer may fine-tune the drum pedal any time during the performance to suit his/her desire and for the best performance.

6 Claims, 6 Drawing Sheets

(56) References Cited

U.S. PATENT DOCUMENTS 6,211,449 B1 * 4/2001 Lai ..... G10D 13/006 84/422.1
6,239,342 B1 * 5/2001 Chang ..... G10D 13/006 84/421
6,255,574 B1 * 7/2001 Sapienza ..... G10D 13/006 84/422.1
6,259,012 B1 * 7/2001 Hoshino ..... G10D 13/006 84/422.1
6,570,076 B1 * 5/2003 Kjellgren ..... G10D 13/006 84/422.1
6,573,443 B1 * 6/2003 Chen ..... G10D 13/006 84/422.1
6,822,149 B1 * 11/2004 Liao ..... G10D 13/006 84/422.1
6,900,380 B2 * 5/2005 Shigenaga ..... G10D 13/006 84/422.2
7,122,730 B2 * 10/2006 Takegawa ..... G10D 13/003 84/422.1
7,297,852 B1 * 11/2007 Chen ..... G10D 13/006 84/422.1
7,408,104 B2 * 8/2008 Sato ..... G10D 13/006 84/422.1
7,692,084 B1 * 4/2010 Lai ..... G10D 13/006 84/422.1
7,868,236 B1 * 1/2011 Lai ..... G10D 13/006 84/422.1
7,928,305 B1 * 4/2011 Chen ..... G10D 13/006 84/422.1
7,989,688 B2 * 8/2011 Luo ..... G10D 13/006 84/422.1
8,624,097 B1 * 1/2014 Liao ..... G10D 13/006 84/422.1
8,735,705 B1 * 5/2014 Chen ..... G10D 13/006 84/422.1
9,236,038 B1 * 1/2016 Hirasawa ..... G10D 13/006
10,163,425 B2 * 12/2018 Liao ..... G10D 13/006
2007/0044637 A1 * 3/2007 Kjellfren ..... G10D 13/006 84/422.1

* cited by examiner

DRUM PEDAL

BACKGROUND OF THE INVENTION

(a) Technical Field of the Invention

The present invention is generally related to drums, and more particular to a bass drum pedal in a drum kit.

(b) Description of the Prior Art

As shown in FIGS. 4 to 6, a conventional bass drum pedal includes a base 30. A clamping element 31 is disposed to the front section of the base 30 for holding a bass drum. A column 32 is disposed behind the clamping element 31 for supporting a shaft 33 for a cam or sprocket 34 and a holder 36 for a drum beater 35. The cam 34 is coupled to the front end of a pedal board 40 by a chain or other linkage 37. The back end of the pedal board 40 is normally hinged to a heel piece, which is attached to the base 30. The pedal board 40 is tilted upward in the front, where it's linked to the chain 37. As the pedal board 40 is pressed down, the chain 37 is pulled downward to turn the cam 34, causing the drum beater 35 joined to the shaft 33 to swing forward and hit the bass drum. The slant position of and the force of pressing down the pedal board 40 is controlled by an elastic element 41 connected to the shaft 33. The top end of the elastic element 41 is connected to a roller 43 attached to a rocker 42, which is mounted to an outer end of the shaft 33. The bottom end of the elastic element 41 is connected to a threaded rod 44, which runs through a locknut 46 and the holed lug 45 on the lower side of the column 32. The threaded rod 44 is then fastened to an adjustment nut 47. The elastic element 41 may be tightened or loosened by turning the adjustment nut 47. The most inconvenient part of the bass drum pedal is that the adjustment nut 47 is positioned beneath the holed lug 45 and very close to the floor, hence the difficulty of adjustment, whether manually or by the use of a tool.

SUMMARY OF THE INVENTION

Therefore, an objective of the present invention is to provide a novel drum pedal to obviate the shortcomings of difficult adjustments by the prior art. To achieve the objective, the present invention provides a sleeve mounted to an end or both ends of a shaft of the drum pedal. A T shaped screw cap runs through the sleeve and joins to a threaded rod which in turn is connected to an end of an elastic element. The other end of the elastic element is hooked to the lower end of the column of the pedal. The cap screw enables the drummer to conveniently and easily adjust the tension of the elastic element to suit his/her desire even during performance.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specifications and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
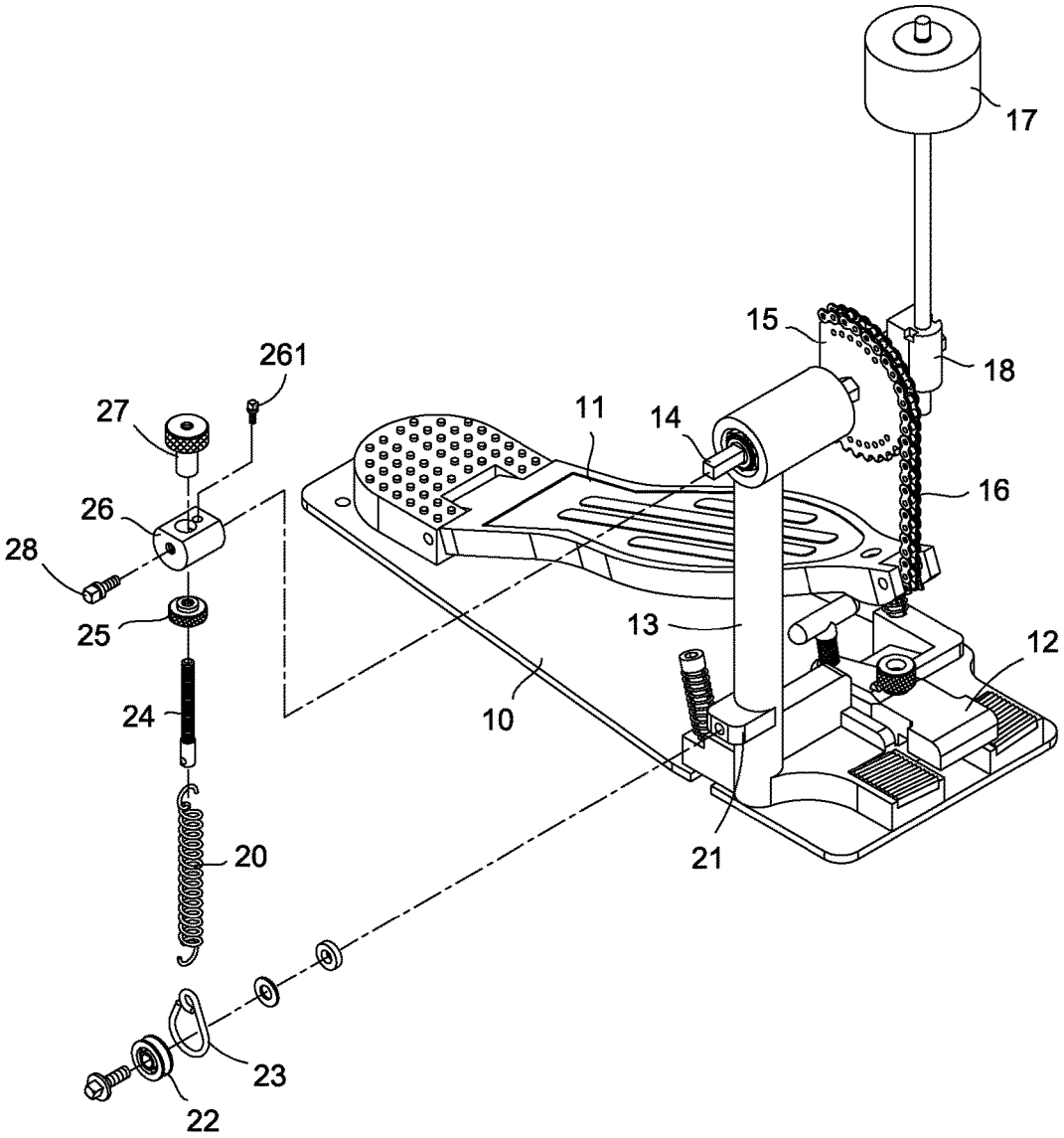
FIG. 1 is a perspective breakdown diagram showing a drum pedal according to an embodiment of the present invention.
Figure 2:
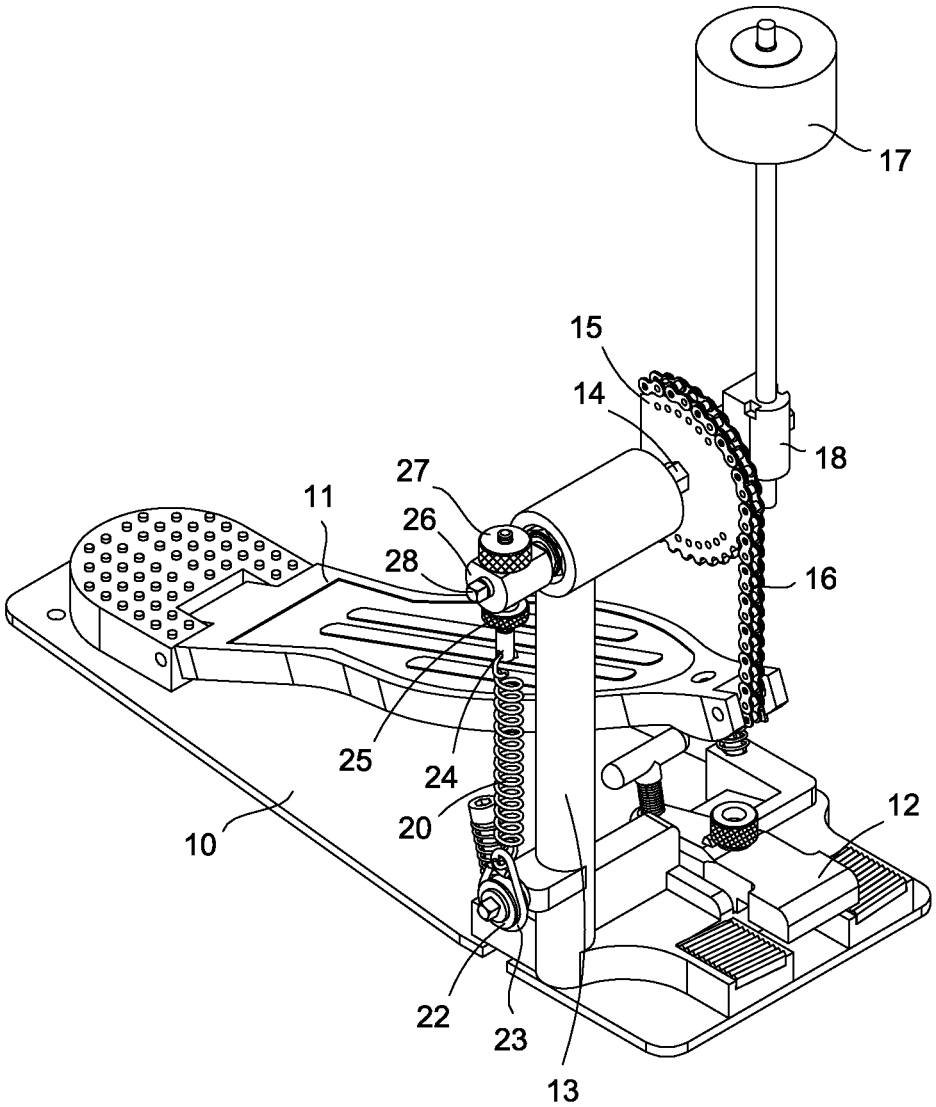
FIG. 2 is a perspective diagram showing the drum pedal of FIG. 1.
Figure 3:
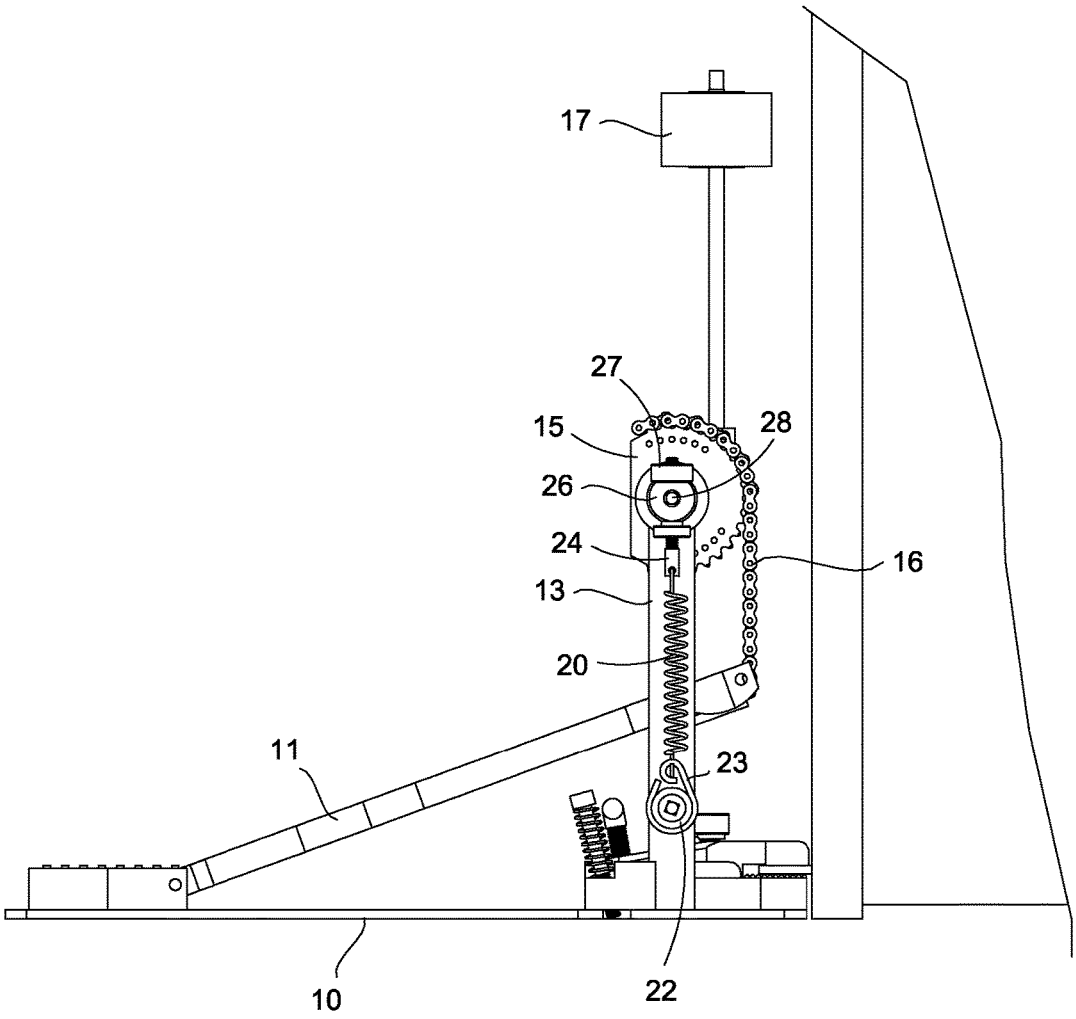
FIG. 3 is a side-view diagram showing the drum pedal of FIG. 1.
Figure 4:
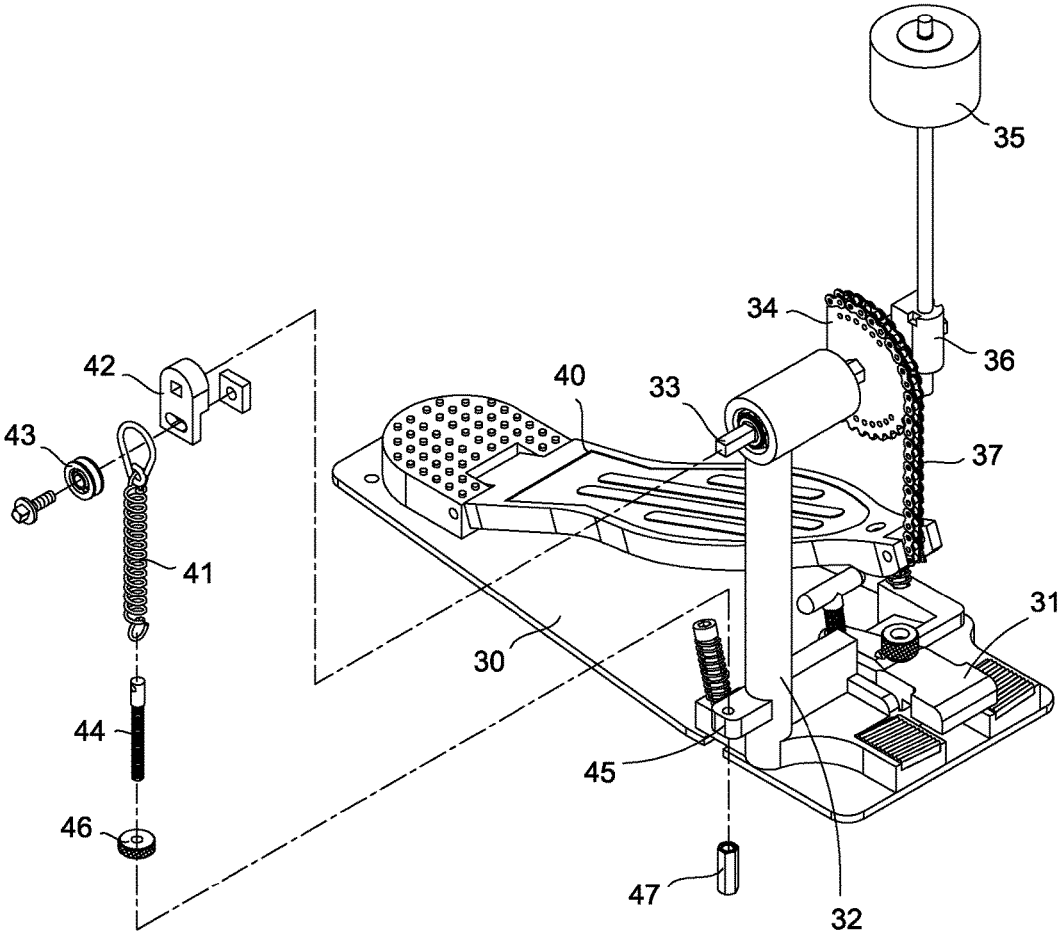
PRIOR ART FIG. 4
FIG. 4 is a perspective breakdown diagram showing a conventional drum pedal.
Figure 5:
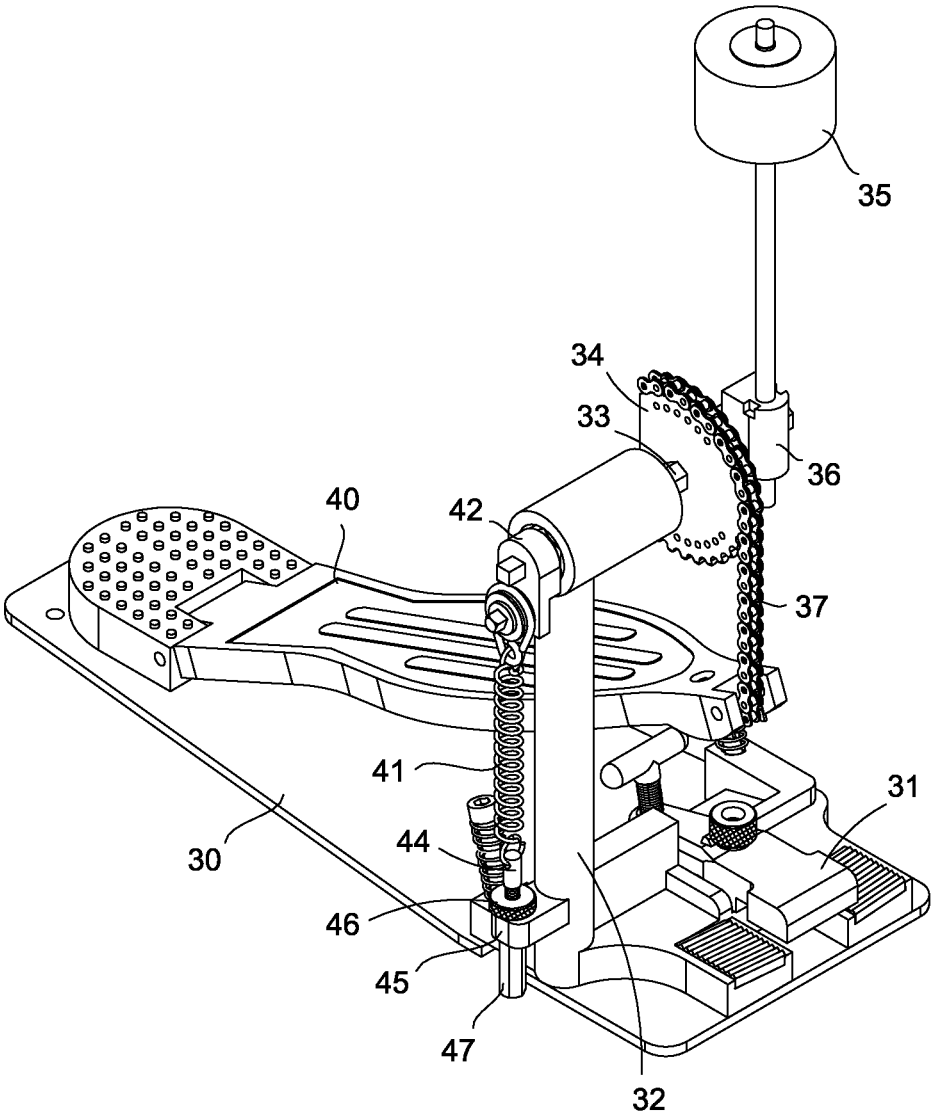
PRIOR ART FIG. 5
FIG. 5 is a perspective diagram showing the conventional drum pedal of FIG. 4.
Figure 6:
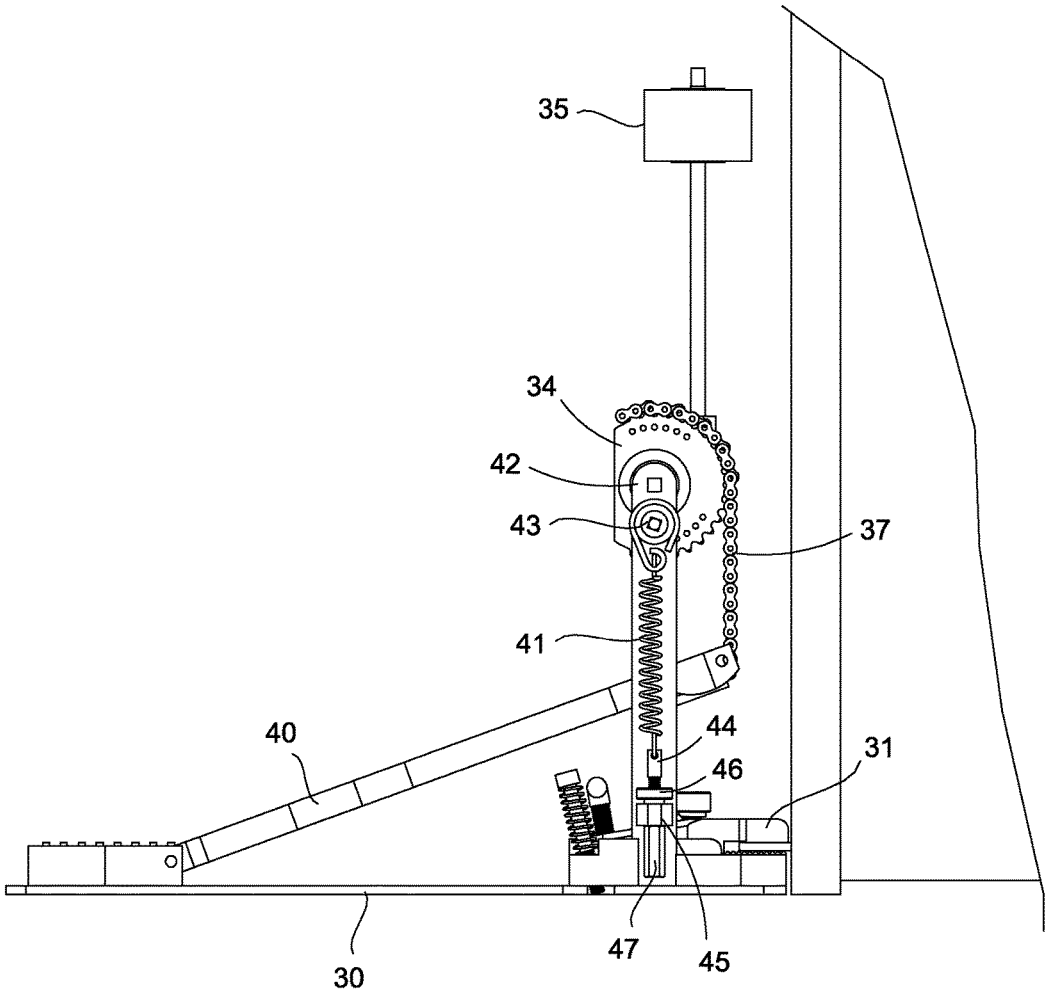
PRIOR ART FIG. 6
FIG. 6 is a side-view diagram showing the conventional drum pedal of FIG. 4.

As shown in FIGS. 1 to 3, a bass drum pedal according to an embodiment of the present invention is structurally similar to a conventional bass drum pedal. It includes a base 10 upon which the bass drum pedal is installed. A pedal board 11 has a back end hinged to a heel piece, which is attached to the base 10 so that the pedal board 11's front end may freely pivot around its back end. A clamping element 12 is disposed in the front section of the base 10 for supporting a bass drum. A column 13 is installed on the base 10. A shaft 14 is rotatably mounted on the top end of the column 13. A cam or sprocket 15 is rotatably mounted on the shaft 14. A chain or other linkage has its top end fixed to the cam and the bottom end connected to the front end of the pedal board 11. With the pull by the chain 16, the pedal board 11 is slantwise positioned relative to the base 10. A drum beater 17 is held in a holder 18 which is mounted on the shaft 14. When the pedal board 11 is pressed downward, the drum beater 17 swings forward to hit the bass drum. A laterally extended plate 21 is disposed to the lower section of the column 13. A roller 22 is fastened to the outer end of the plate 21. A loop 23 is configured to the bottom end of the elastic element 20, and the loop 23 in turn circles the roller 22. the top end of the elastic element 20 is connected to the bottom end of a threaded rod 24. The threaded rod 24 runs through a locknut 25. A sleeve 26 is mounted to one end of the shaft 14. The sleeve 26 has a matching shape of channel compatible with the end of the shaft 14 so that it can be received by the shaft. A bolt 261 may be applied through the sleeve 26 to fix the sleeve 26 to the shaft 14. The sleeve 26 provides a through hole for a T-shaped screw cap 27 to run through. The screw cap 27 has a larger head portion above the sleeve 26. For the ease of operation, the head portion of the screw cap 27 could be textured or arranged in a polygonal manner. The threads inside the T shaped screw cap 27 allow for coupling with the threaded rod 24. By turning the screw cap 27, the elastic element 20 may be stretched or loosened. Once the elastic element 20 reaches the desired tension, a bolt 28 is applied through the sleeve 26 to lock up the screw cap 27. The bolt 28 may be applied to the front, rear or lateral side of the sleeve 26, preventing it from getting loose. The locknut 25 on the threaded rod 24 may be applied simultaneously to the bottom side of the sleeve 26, further ensuring that the threaded rod 24 and the elastic element 20 do not back loose during drum performance. The advantages of the present invention are as follows. The screw cap 27 for adjusting the tension of the elastic element 20 is positioned above the sleeve 26 on the shaft 14. The bottom end of the elastic element 20 is fixed to the roller 22 at the lower end of the column 13. The elastic element 20 is, therefore, configured in a reverse manner compared to the prior art. The top end of the elastic element 20 is connected to the threaded rod 24, which runs through the locknut 25 and is then coupled to the screw cap 27, the head portion of which rests on the sleeve 26. The tension of the elastic element 20 may be, therefore, conveniently adjusted by turning the screw cap 27. The drummer now may find it's easier than before to fine-tune the drum pedal any time during the performance While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A drum pedal, comprising:

a base having a clamping element disposed in a front section for supporting a drum;

a column installed on and extended upward from the base;

a shaft rotatably mounted on a top end of the column;

a drum beater held in a holder mounted on the shaft;

a cam rotatably mounted on the shaft;

a pedal board having a back end hinged to a heel piece, which is attached to the base so that the pedal board may freely pivot around its back end;

a linkage having its top end fixed to the cam and a bottom end connected to a front end of the pedal board so that the pedal board is slantwise positioned relative to the base; and an elastic element having a top end coupled to one end of the shaft and a bottom end fixed to a lower end of the column, wherein a plate is laterally extended out; a roller is fastened to the plate; a loop at a bottom end of the elastic element is hooked to the roller; a top end of the elastic element is connected to a bottom end of a threaded rod; the threaded rod and a screw cap are connected via a sleeve mounted to the outer end of the shaft; and the screw cap provides tensioning adjustment to the elastic element and, therefore, the force of exertion when pressing down the pedal board.

2. The drum pedal according to claim 1, wherein the threaded rod runs through a locknut beneath the sleeve; and the locknut further secures the elastic element.

3. The drum pedal according to claim 1, wherein the screw cap is T-shaped; a head portion of the screw cap rests above the sleeve; and the head portion has its circumference textured or is shaped in a polygonal manner for easier operation.

4. The drum pedal according to claim 1, wherein a bolt is applied through the sleeve to lock up the screw cap.

5. The drum pedal according to claim 4, wherein the bolt is applied to a front, rear or lateral side of the sleeve.

6. The drum pedal according to claim 1, wherein, after the sleeve is mounted on the shaft, a bolt is applied through the sleeve to fix the sleeve to the shaft.

* * * * *